US010646002B2

(12) United States Patent
Muller

(10) Patent No.: US 10,646,002 B2
(45) Date of Patent: May 12, 2020

(54) NO SLIP ONE-PIECE STRAP ADJUSTOR

(71) Applicant: Bell Sports, Inc., Scotts Valley, CA (US)

(72) Inventor: Hilgard N. Muller, Felton, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

(21) Appl. No.: 16/016,513

(22) Filed: Jun. 22, 2018

(65) Prior Publication Data

US 2018/0295946 A1 Oct. 18, 2018

Related U.S. Application Data

(63) Continuation of application No. 14/671,356, filed on Mar. 27, 2015, now Pat. No. 10,039,349.

(60) Provisional application No. 61/972,096, filed on Mar. 28, 2014.

(51) Int. Cl.
*A44B 11/04* (2006.01)
*A42B 3/08* (2006.01)

(52) U.S. Cl.
CPC ..... *A44B 11/04* (2013.01); *A42B 3/08* (2013.01); *Y10T 24/2192* (2015.01)

(58) Field of Classification Search
CPC .. A44B 11/04; Y10T 24/2192; Y10T 24/4093
See application file for complete search history.

(56) References Cited

U.S. PATENT DOCUMENTS

| | | | | |
|---|---|---|---|---|
| 4,282,634 | A | 8/1981 | Krauss | |
| 4,296,531 | A * | 10/1981 | Bengtsson | A44B 11/006 24/200 |
| 4,815,174 | A * | 3/1989 | Sou | A01K 27/004 24/136 R |
| D576,076 | S * | 9/2008 | Yoshiguchi | D11/218 |
| D576,077 | S * | 9/2008 | Yoshiguchi | D11/218 |
| 7,950,072 | B1 | 5/2011 | Hanson | |
| 8,984,723 | B2 * | 3/2015 | Pitman | A41F 15/002 24/200 |
| 2005/0086772 | A1 * | 4/2005 | Yoshiguchi | A44B 11/04 24/197 |

(Continued)

FOREIGN PATENT DOCUMENTS

RU 2010147638 2/2012

*Primary Examiner* — Victor D Batson
*Assistant Examiner* — Matthew J Sullivan
(74) *Attorney, Agent, or Firm* — Walter M. Egbert, III; Gerard M. Donovan; Reed Smith LLP

(57) ABSTRACT

A strap adjustor can comprise a first surface, a second surface opposite the first surface, a third surface that extends between the first surface and the second surface. A first opening in the first surface can extend completely through the strap adjustor between the first surface and the second surface. A second opening in the first surface can extend partially but not completely through the strap adjustor. A bar can be disposed at the first surface between the first opening and the second opening. A third opening in the third surface can extends partially but not completely through the strap adjustor and join with the second opening. At least one strap can be disposed partially through the third opening, and the at least one strap can comprise an uncompressed thickness that is greater than a height of the third opening.

19 Claims, 9 Drawing Sheets

(56) References Cited

U.S. PATENT DOCUMENTS

| | | | | |
|---|---|---|---|---|
| 2008/0078069 | A1* | 4/2008 | Pontaoe | A44B 11/04 24/196 |
| 2008/0155792 | A1* | 7/2008 | Yeh | A44B 11/04 24/169 |
| 2009/0282653 | A1* | 11/2009 | Yang | A43C 7/00 24/129 R |
| 2010/0170065 | A1* | 7/2010 | Paik | A44B 11/04 24/163 R |
| 2013/0097828 | A1* | 4/2013 | Hashimoto | A44B 11/006 24/68 E |
| 2014/0049060 | A1 | 2/2014 | Rayner | |
| 2015/0074951 | A1* | 3/2015 | Grimm | A44B 11/006 24/190 |
| 2018/0317611 | A1* | 11/2018 | Rittenhouse | A44B 11/04 |

* cited by examiner

--Prior Art--

--Prior Art--

NO SLIP ONE-PIECE STRAP ADJUSTOR

RELATED APPLICATIONS

This application is a continuation application of the U.S. Non-provisional application Ser. No. 14/671,356, filed on Mar. 27, 2015, titled "No Slip One-Piece Strap Adjustor," now pending, which was based on, claims priority to, and incorporates herein by reference in its entirety U.S. provisional patent application 61/972,096, filed Mar. 28, 2014 titled "No Slip 1-Piece Adjustor."

TECHNICAL FIELD

This disclosure relates to a no slip one piece-strap adjustor for use in strap adjustment. The no slip adjustor can be employed on straps in myriad applications, including wherever a conventional strap adjustor is used, such as for releasably attaching a protective helmet to a head of a user.

BACKGROUND

This disclosure relates to strap adjustors and to devices, products, and items that include straps and include adjustment of the straps. Devices using straps can include protective gear, such as helmets, or other articles and devices including straps that require adjustment. Straps can be adjusted to increase or decrease an effective length of the strap, to bring together more than one strap from different angles, and to customize a fit of the strap to the device or the user. Adjusting a length or orientation of straps can allow for improved fit between the strap, protective gear, helmet, or other article and the customer.

FIG. 1A shows a top view of a conventional one-piece strap adjustor 10, as known in the prior art. The conventional one-piece strap adjustor 10 has also been referred to as a strap slide or as a slide lock strap adjustor. The conventional one-piece strap adjustor 10 can include a first opening 12 and a second opening 14, each of which are formed in and through the conventional one-piece strap adjustor and extend from a first surface to a second surface opposite the first surface. The first opening 12 and the second opening 14 can be integrally formed through a single material, thus making the conventional one-piece strap adjustor 10 a one-piece device. The first opening 12 and the second opening 14 can be thought of as being defined by an outer perimeter portion 16 and a center bar 18. The outer perimeter portion 16 can be thought of as being defined by side rails of side portions 20 that are perpendicular or substantially perpendicular to the center bar 18. The outer perimeter portion 16 can also be thought of as being defined by a top rail 22 and a bottom rail 24 that are perpendicular or substantially perpendicular to the side rails 20, or stated another way, the top rail 22 and the bottom rail 24 can be parallel or substantially parallel to the center bar 18.

A width of the first opening 12 and the second opening 14 can comprise widths that are larger, or slightly larger than, widths of straps that will be disposed through the first opening 12 and the second opening 14. Similarly, heights of the first opening 12 and the second opening 14 can comprise heights that are larger, or slightly larger, than thicknesses of the straps that will be disposed through the first opening 12 and the second opening 14. FIG. 1B shows an example of how a first strap 36 and a second strap 38 can be threaded through the conventional one-piece strap adjustor 10.

FIG. 1B shows a perspective side view of a conventional one-piece strap adjustor 10 with a first strap 26 and a second strap 28 being inserted through, and extending between, the first opening 12 and the second opening 14. As shown on a right side of FIG. 1B, the first strap 26 and the second strap 28 can come to the conventional one-piece strap adjustor 10 from different positions or angles, such as from attachment points to a helmet or other device. At or near the conventional one-piece strap adjustor 10 the first strap 26 and the second strap 28 can be joined or stacked upon each. Upon exiting the conventional one-piece strap adjustor 10 at a left side of FIG. 1B, the first strap 26 and the second strap 28 can leave the one piece adjustor at a same or similar angle or direction.

In addition to the conventional one-piece strap adjustor 10 shown in FIGS. 1A and 1B, other adjustors can also be used to receive and direct straps. These other adjustors include adjustors that have multiple pieces that can move with respect to each other, being pined, hinged, or moveably coupled together. An example of a multi-piece adjustor is a two-piece adjustor that allows two straps to pass from opposing first and second sides of the two-piece adjustor, wherein the first strap 26 and the second strap 28 would be held together by the two separate but attachable pieces of the adjustor being clamped together around the two straps to securely couple the straps to each other and to the two-piece adjustor.

SUMMARY

A need exists for a strap adjustor. Accordingly, in an aspect, a one-piece strap adjustor can comprise a first surface, a second surface opposite the first surface, and a third surface that extends between the first surface and the second surface. A first opening can be formed in the first surface, wherein the first opening extends completely through the strap adjustor between the first surface and the second surface. A second opening can be formed in the first surface that extends partially but not completely through the strap adjustor. A bar can be disposed at the first surface between the first opening and the second opening. A third opening can be formed in the third surface and extend partially but not completely through the strap adjustor to join with the second opening. At least one strap can be disposed partially through the third opening, the at least one strap comprising an uncompressed thickness that is greater than a height of the third opening.

The strap adjustor can also be formed so that the third opening compresses the at least one strap to prevent the at least one strap from slipping through the third opening when tension is reduced along a length of the at least one strap. The bar can comprise a textured surface to increase friction or resistance between the bar and the at least one strap. The second opening can intersect with the third opening to provide a void into which the at least one strap can be disposed, and the at least one strap can change directions within the void before exiting the void through the third opening. The second surface can comprise an included angle about the first opening that is less than 180 degrees. The third surface can be substantially perpendicular to the first surface or the second surface. A method of making the strap adjustor can comprise molding the strap adjustor of a single piece of plastic.

In another aspect, a one-piece strap adjustor can comprise a first surface, a second surface opposite the first surface, and a third surface that extends between the first surface and the second surface. A first opening can be formed in the first surface, wherein the first opening extends completely through the strap adjustor between the first surface and the second surface. A second opening can be formed in the first surface that extends partially but not completely through the strap adjustor. A third opening can be formed in the third surface that extends partially but not completely through the strap adjustor to join with the second opening.

The one-piece strap adjustor can further comprise a bar at the first surface between the first opening and the second opening, wherein the bar comprises a textured surface to increase friction or resistance between the strap adjustor and a strap that passes over the bar. The strap adjustor can be formed so that the second opening intersects with the third opening to provide a void into which a strap can be disposed, and the strap can change directions within the void before exiting the void through the third opening. The second surface can comprise an included angle that is less than 180 degrees. The third surface can be substantially perpendicular to the first surface or the second surface. The first surface can be substantially parallel to the second surface. A first strap can be disposed partially through the third opening with a length of the first strap being substantially perpendicular to a width of the third opening or a height of the third opening, and a second strap can be stacked over the first strap, the second strap being disposed partially through the third opening with a length of the second strap being substantially perpendicular to a width of the third opening or a height of the third opening, and a height of the third opening being less than an uncompressed thickness of the first strap and the second strap. A height of the third opening can be equal to a compressed thickness of the first strap and the second strap, and the third opening can compress the first strap and the second strap to prevent the first strap and the second strap from slipping through the third opening when tension is reduced along a length of the first strap or the second strap. A method of making the one-piece strap adjustor comprising molding the strap adjustor of a single piece of plastic.

In another aspect, the one-piece strap adjustor can further comprise a first void that extends completely through the strap adjustor between a first surface and an opposing second surface, and a second void that extends partially but not completely through the strap adjustor.

The one-piece strap adjustor can further comprise the second void being angled between the first surface and the second surface. The second void can comprise a second opening at the first surface and a third opening in a third surface that extends between the first surface and the second surface. The third surface can be perpendicular to the first surface or the second surface.

DETAILED DESCRIPTION

Figure 1A:
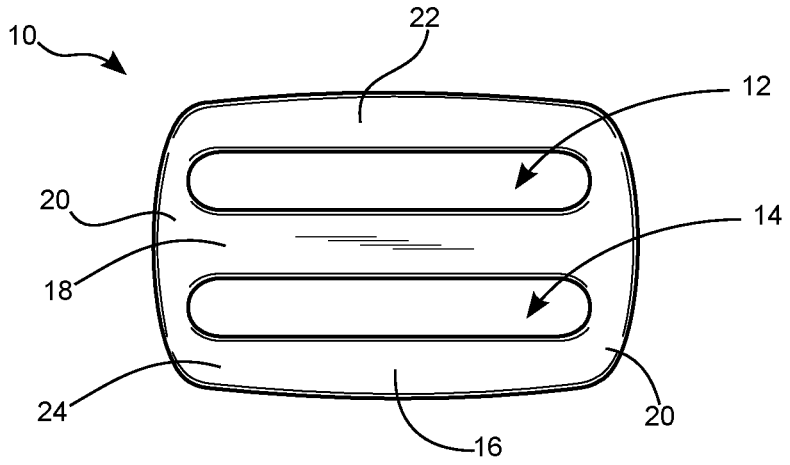
FIGS. 1A and 1B show a view of a strap slide, slide lock strap adjustor, or conventional one-piece strap adjustor as known in the prior art.

This disclosure, its aspects and implementations, are not limited to the specific helmet, strap or strap adjustor material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity and because one of ordinary skill in the art will understand the breadth of various other alternate examples from the disclosure and alternative examples provided herein.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a system and method for adjusting one or more straps, including helmet straps or straps for protective gear, such as helmet straps for a cyclist, football player, hockey player, baseball player, lacrosse player, polo player, climber, auto racer, motorcycle rider, motocross racer, skier, snowboarder or other snow or water athlete, sky diver or any other athlete in a sport or other person who is in need of protective head gear. Strap adjustment for helmets can further include other industries that use protective headwear, such as a construction, soldier, fire fighter, pilot, or other worker in need of a safety helmet, where similar straps and methods of strap adjustment are needed. More broadly, strap adjustment of bags, backpacks, satchels, other protective equipment including goggles, glasses, slings, pads, shin guards, chest protectors, or other clothing, equipment, gear, or luggage is also contemplated.

Figure 2A:
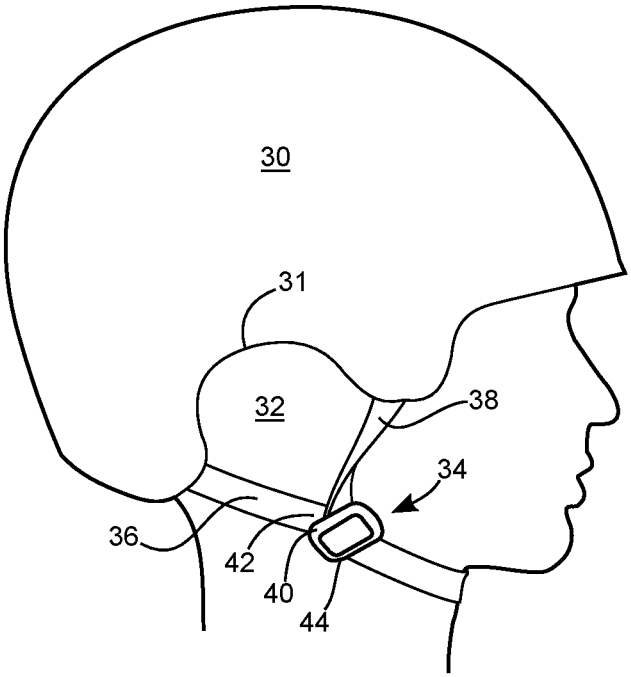
FIGS. 2A-2F show various views of an embodiment of a no slip one-piece strap adjustor.

FIG. 2A, shows a side view of a helmet 30 coupled to a head of a user 32 with a one-piece adjustor or "adjustor" 34. The adjustor 34 is coupled to a first strap 36 and a second strap 38 that pass through the adjustor 34 and assist in coupling the helmet 30 to the head of the user 32. FIG. 2A also shows a front or first surface 40 of the adjustor 34 that can be oriented away from the head of the user 32. While the adjustor 34 can, for convenience, be referred to as a no slip adjustor, some slippage or relative movement is still possible. As used herein, the term no slip as used with respect to the adjustor 34 can mean that slippage or relative movement between the adjustor 34 and the first strap 36 and the second strap 38, can be minimal, de minimis, negligible, or reduced with respect to the conventional one-piece strap adjustor 10 and the first strap 26 and the second strap 28. Due to particular features of the adjustor 34, which are discussed in greater detail below, the first strap 36 and the second strap 38 do not have a tendency to loosen and move relative to each other or relative to the adjustor 34 as is the case with the conventional one-piece strap adjustor 10 and the first strap 26 and the second strap 28 if there is not constant tension applied to the first strap 36 and the second strap 38.

FIG. 2A shows that the adjustor 34 can be used to hold one or more straps together, such as one strap, two straps, a plurality of straps, or any number of straps, and can additionally be used to align the straps in an arrangement, alignment, or position that is desirable or advantageous for the user 32. While various embodiments are discussed below with respect to the first strap 36 and the second strap 38, the adjustor 34 can also be configured to receive any number of straps, including one thick strap. As such, the term "straps" is used throughout the specification, for convenience, to denote embodiments in which one strap or a plurality of straps can be used. Whatever the number of straps, the straps can be made of rope, cord, twine, webbing, fabric, or any other suitable braided, twisted, woven, pressed, planar, or laminar material comprising, fabric, plastic, resin, fiber, polymer, or other suitable material. As a non-limiting example, the first strap 36 and the second strap 38 can comprise nylon webbing.

As a non-limiting example, FIG. 2A shows an embodiment in which two different straps, the first strap 36 and the second strap 38, can be attached or coupled to the helmet 30. The first strap 36 can be attached toward a rear portion of the helmet on a rear or first side of an ear opening 31 and the second strap 38 can be attached toward a front of the helmet on a second side of the ear opening 31 so that the first strap 36 and the second strap 38 can be separated by the ear opening 31. The adjustor 34 can be oriented such that a front surface 40 of the adjustor 34 is oriented away from a head of the user 32. The adjustor 34 can also be configured to receive the first strap 36 and the second strap 38 at different angles relative to a top edge 42 of the adjustor 34. The first strap 36 and the second strap 38 can then pass out of the adjustor 34 at a bottom edge 44 of the adjustor 34 opposite the top edge 42. When the straps pass out of the adjustor 34 near the bottom edge 44, the first strap 36 and the second strap 38 can exit at a same angle relative to the adjustor 34 and be stacked on top of each other. As such, the adjustor 34 can receive straps from different portions of the helmet 30 and align the straps into a single direction for a safe and comfortable fit with the head of user 32. Additionally, the strap adjustor 34 can be used to adjust one or more of a length, position, or ordination of helmet straps to suitably position and couple the first strap 36 and the second strap 38 into place below a chin or jaw of the user 32 to keep the helmet 30 secured to the head of the user 32 while wearing the helmet 30.

The terms "top" and "bottom" as used herein with respect to the top edge 42 and the bottom edge 44 are relative non-limiting terms that are used for convenience of description. The top and bottom correspond to a height of the adjustor, which is included in a y-direction. Similarly, a width corresponds to an x-direction, and a thickness or depth corresponds to a z-direction, and the x-direction, y-direction, and z-direction can all be perpendicular or orthogonal to each other. As used herein a "top" side or portion of the adjustor 34 can be the side of the adjustor that will be disposed or oriented towards the user 32 when in normal use. For example, the top edge 42 of the adjustor 34 can be oriented towards the head of the user 32 when the adjustor 34 is worn in conjunction with the helmet 30 and the first strap 36 and the second strap 38. Conversely, as used herein a "bottom" side or portion of the adjustor 34 can be the side of the adjustor 34 that will be disposed away from the user 32 when in normal use. For example, the bottom edge 44 of the adjustor 34 can be oriented away from the head of the user 32, or from where first strap 36 and the second strap 38 are attached to the helmet 30. However, the orientation of the adjustor 34 with respect to the top edge 42 and bottom edge 44, as well as the x, y, and z directions are for convenience, are non-limiting, and can be reversed or modified without departing from the scope of the disclosure.

Figure 2B:
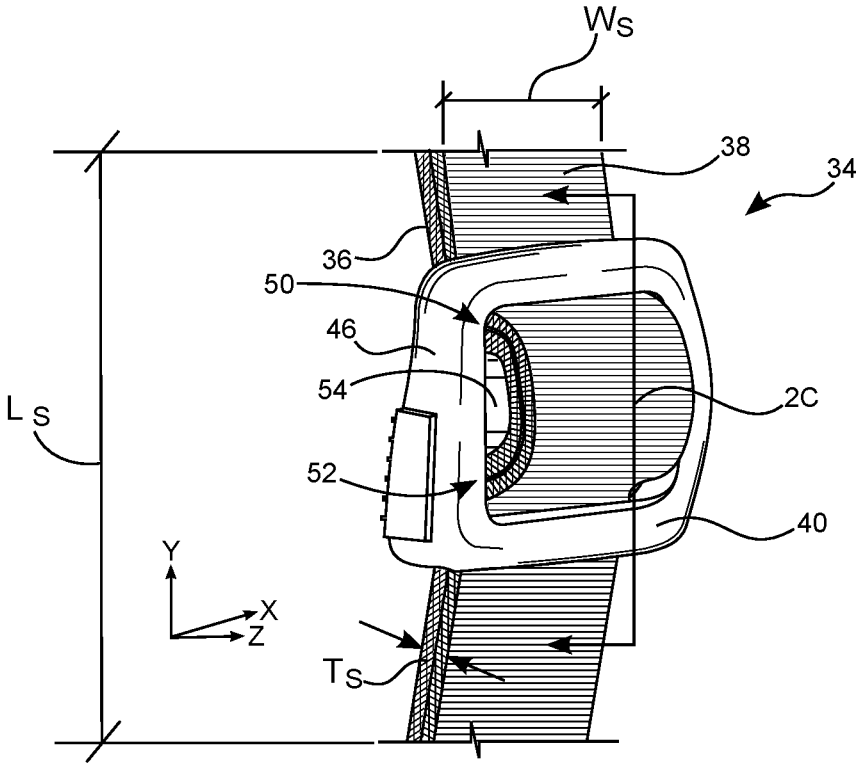

Additional detail of the adjustor 34 is now discussed below with respect to FIGS. 2B-2F. FIG. 2B shows a close-up perspective view showing the front surface 40 and a side surface 46 of the adjustor 34 that extends from the front surface to a back surface 48 opposite the front surface. The first strap 36 and the second strap 38 are shown passing through, and being held by, the adjustor 34.

While FIG. 2B shows the second strap 38 disposed over the first strap 36 and nearer the front surface 40, the relative positions of the first strap 36 and the second strap 38 could be changed based on user preference or other design considerations, such as how the first strap 36 and the second strap 38 are attached to the helmet 30. As shown in FIG. 2B, each of the first strap 36 and the second strap 38 can comprise a length Ls that is transverse to a width Ws of the straps. As a non-limiting example, the length of the straps Ls can be threaded through the adjustor 34 by inserting the first strap 36 and the second strap 38 into, and passing through, a first opening 50 in the front surface 40 of the adjustor 34 near the top edge 42 of the adjustor 34. The first strap 36 and the second strap 38 can pass through the first opening 50 from the back surface 48 and extend out over the front surface 40 of the adjustor 34. The first strap 36 and the second strap 38 can then extend up and over a contact area or bar 54 that separates the first opening 50 and the second opening 52. After passing over the bar 54, the first strap 36 and the second strap 38 can then extend down through the second opening 52 through the front surface 40 to subsequently exit the adjustor 34 near the bottom edge 44 through a side surface 46 that extends between the front surface 40 and the back surface 48.

Alternatively, in another embodiment the structure of the adjustor 34 could be reversed such that the ordering or direction of threading the first strap 36 and the second strap 38 through the adjustor 34 could also be reversed. In such an embodiment, the "front" and "back" surfaces as used herein with respect to the front surface 40 and the back surface 48 could be reversed because the terms front and back are relative non-limiting terms that are used for convenience of description. As used herein the front surface 40 of the adjustor 34 can be the side of the adjustor that will be disposed or oriented away the user 32 when in normal use. Conversely, as used herein the back surface 48 of the adjustor 34 can be the side of the adjustor that will be disposed or oriented towards the user 32 when in normal use. However, the orientation of the adjustor 34 with respect to the front surface 40 and the back surface 48 is non-limiting, and can be reversed without departing from the scope of the disclosure.

Continuing with the embodiment in which the structure of the adjustor 34 is reversed, the first strap 36 and the second strap 38 can pass through the first opening 50 from the front surface 40 and extend out over the back surface 48 of the adjustor 34. The first strap 36 and the second strap 38 can then extend over to, and pass through, a second opening formed through the back surface 48 to subsequently exit the adjustor 34 near the bottom edge 44 through a third opening 56 in a side surface 46 that extends between the front surface 40 and the back surface 48. The above describe threading patterns and path of the first strap 36 and the second strap 38 through the adjustor 34 is further clarified by the cross-sectional view of the adjustor 34 presented in in FIG. 2C.

Figure 2C:
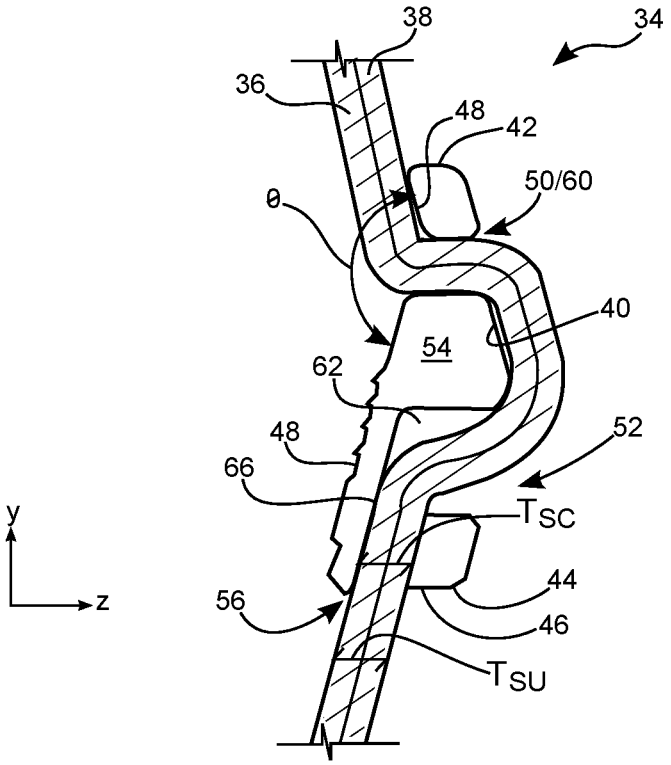

FIG. 2C shows a cross-sectional view of the adjustor 34 from FIG. 2B. FIG. 2C shows the first strap 36 and the second strap 38 threaded through the adjustor 34 at the first opening 50, the second opening 52, and the third opening 56. The top edge 42 of the adjustor 34 is shown at a top of the figure and the bottom edge 44 is shown at the bottom of the figure. The top edge 42 of the adjustor 34 can be oriented in a direction that is generally disposed away from the ground when worn by the user 32. On the other hand, the bottom edge 44 of the adjustor 34 can be oriented in a direction that is generally disposed towards the ground when worn by the user 32. In any event, an orientation of the first strap 36 and the second strap 38 when entering the adjustor 34 aligned with the first opening 50 can be in a direction that is perpendicular, or substantially perpendicular, to a direction in which the first strap 36 and the second strap 38 exit the adjustor 34 aligned with the third opening 56. As used herein, substantially perpendicularly can include relative angles that are 90 degrees plus or minus 30 degrees or less, plus or minus 20 degrees or less, or plus or minus 10 degrees or less. In this respect the adjustor 34 differs from conventional adjustors 10, in which the first and second straps 26 and 28 enter and exit openings on a same surface at roughly equal or parallel angles to each other and are not substantially perpendicular to each other.

Figure 1B:
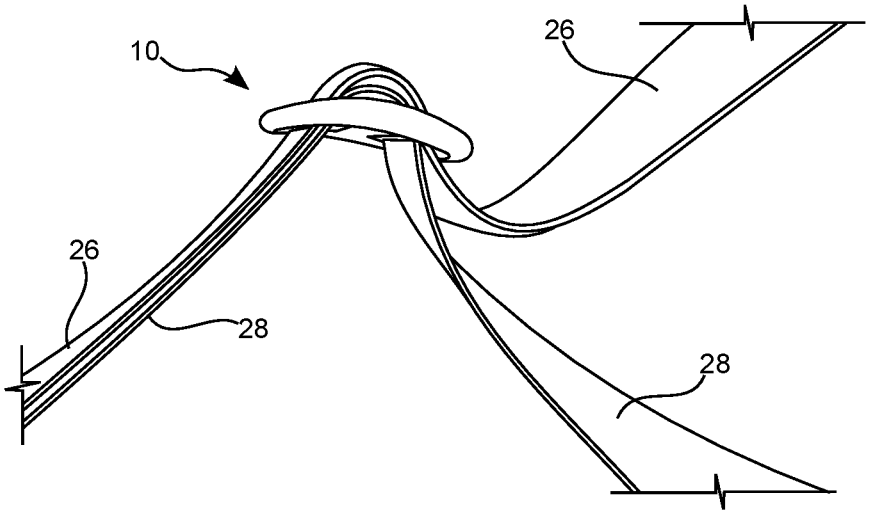

As shown in FIG. 2C, the first opening 50 through the front surface 40 of the adjustor 34 can extend straight, directly, or substantially so, through the adjustor 34 without turns, curves, angles, or bends to the back surface 48 of the adjustor 34 to form the first void 60. Thus, the first void 60 can comprise a shape or volume that is straight, direct, or substantially so, without turns, curves, angles, or bends. The second opening 52 through the front surface 40 of the adjustor 34 can extend straight, directly, or substantially so, through the adjustor 34 before turning, curving, or angling, to the third opening 56 through the side surface 46 of the adjustor 34 to form the second void 62. As shown in FIG. 2C, the second void 62 can be larger than the first void 60. By forming the second void 62 to extend between adjacent, intersecting, or substantially perpendicular surfaces, sides, or ends of the adjustor 34, such as the front surface 40 and the side surface 46, a pathway of the first strap 36 and the second strap 38 can be different than those of conventional one piece adjustors 10, as shown in FIGS. 1A and 1B, wherein the conventional adjustor 10 comprises first and second openings 12 and 14 that pass through the same front and back opposing surfaces.

Stated another way, while the first opening 12 and the second opening 14 in the conventional one-piece strap adjustor 10 enters and exits only two surfaces or sides of the conventional adjustor 10, the adjustor 34 described herein comprises openings, such as first opening 50, second opening 52, and third opening 56, or voids, such as first void 60 and second void 62, that enter and exit at least three different surfaces or sides of the adjustor 34, such as the front surface 40, the side surface 46, and the back surface 48. In some embodiments, the adjustor 34 can be modified such that the first void 60 and the second void 64 are both formed similar to the second void 64 in that each of the first void 60 and the second void 64 can comprise a turn, curve, angle, bend, or change of direction. As such, the the adjustor 34 can also comprise openings that enter and exit the front surface 40 and two opposing side surfaces 46. In other embodiments, the adjustor 34 can comprise openings in 4 or more surfaces or sides of the adjustor.

As further shown in FIG. 2C, the first strap 36 and the second strap 38 can enter the first void 60 and pass through the first opening 50 near the top edge 42 of the adjustor 34 by coming from the back surface 48 of the adjustor and exiting the first void 60 and the first opening 50 at the front surface 40. The first strap 36 and the second strap 38 can then pass over and contact the front surface 40 at the bar 54 before then entering the second opening 52 and the second void 62 from the front surface 40 of the adjustor 34 near the bottom edge 44 of the adjustor. After entering the second opening 52, the first strap 36 and the second strap 38 can turn, bend, angle, or otherwise change direction within the second void 62 to contact an interior surface 66 of the second void 62 opposite the back surface 48, wherein a distance or offset between the interior surface 66 and the back surface 48 define a thickness of at least a portion of the adjustor 34. After the first strap 36 or the second strap 38 contact the interior surface 66, the first strap 36 and the second strap 38 can then exit the third opening 56 through the side surface 46 at the bottom edge 44 of the adjustor 34.

While the front surface 40 and back surface 48 of the adjustor 34 can be parallel or substantially parallel, they need not be. As shown in FIG. 2C, the front surface 40 and back surface 48 can be formed at angles that if continued, would lead the front surface 40 and the back surface 48 to intersect, such as at the top edge 42, the bottom edge 44, or both. In some instances, one or both of the front surface 40 and the back surface 48 can include multiple angles, one or more of which will correspond and be parallel with the other. For example, the back surface 48 of the adjustor 34 can be angled or peaked about a point or line of the back surface 48, such as at the first void 60. Similarly, the front surface 40 of the adjustor 34 can also be angled or peaked at a same or different location than the back surface 48, such as at the bar 54. The angles or relative orientations of the front surface 40 and the back surface 48 with respect to each other and with respect to a position of the first strap 36 and the second strap 38 passing through or coupled to the adjustor 34 can be adjusted and modified according to a desired orientation of the straps to provide an ergonomic and desired fit for the user 32. The relative angles of the adjustor 34, including the position and orientation of the first opening 50, the second opening 52, and the third opening 56, can combine to form a "treacherous path" within the adjustor 34 that which will determine an ease of strap adjustment, or an amount of force that needs to be applied by the user 32 to move or change a position of the adjustor 34 with respect to the first strap 36 and the second strap 38.

As shown in FIG. 2C, an angle θ can be defined by an interior angle between multiple portions of the back surface 48 of the adjustor 34. The angle θ can also correspond to, and be equal or substantially equal to, a relative interior angle between the portions of the straps that are entering and exiting the adjustor 34, such as the first strap 36 and the second strap 38 at the top edge 42 and the first strap 36 and the second strap 38 at the bottom edge 44 of the adjustor 34. In some instances, the angle θ can less than 180 degrees, or less than 150 degrees, or less than 120 degrees, or in a range of 120-150 degrees.

FIG. 2C also shows that a thickness of the straps while compressed (Tsc) can be less than a thickness of the straps when the straps are uncompressed (Tsu). The thickness of the compressed straps Tsc can be compressed by the third opening 56 in the side surface 46 of the adjustor 34, which can be represented by the expression Tsc>Tsu. By compressing the thickness Tsc of the first strap 36 and the second strap 38, slippage or relative movement among the adjustor 34 and the first strap 36 and the second strap 38 can be reduced, minimized, or eliminated, even when tension is not being applied to the first strap 36 and the second strap 38, which hitherto has not been accomplished with a conventional one-piece strap adjustor 10.

Figure 2D:
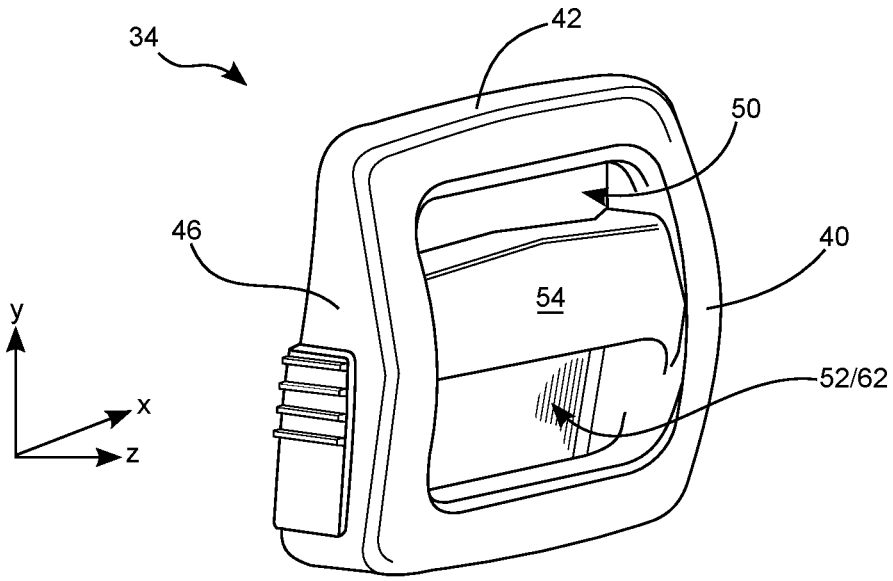
Figure 2E:
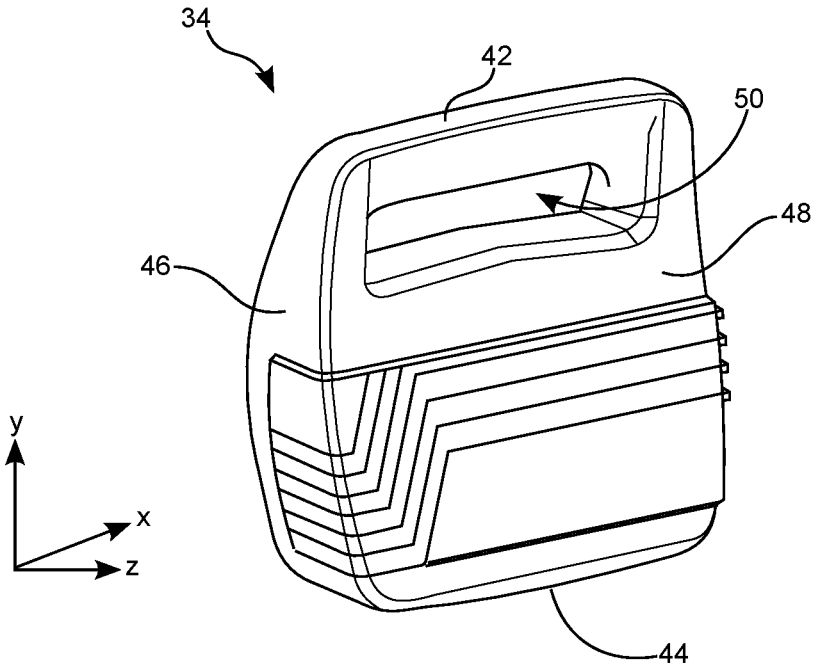
Figure 2F:
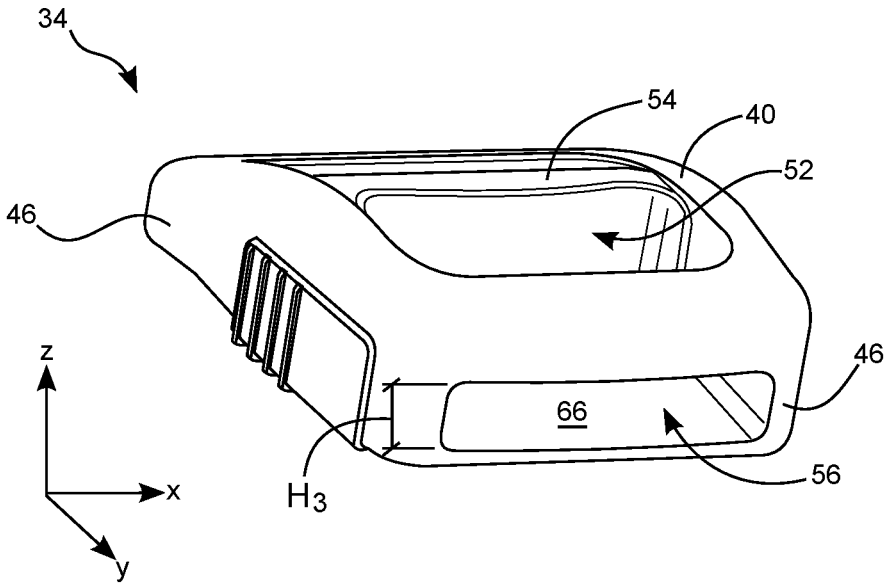

FIGS. 2E-2F provide additional perspective views and detail for the adjustor 34. In particular, FIG. 2D shows a perspective view of the front surface 40 and the side surface 46 of the adjustor 34. Additionally, FIG. 2D shows the second opening 52 formed in the front surface 40 can be larger than the first opening 50 formed in the front surface 40. Additionally, the second opening 52, rather than being an opening that extends directly down through the adjustor 34 and through the back surface 48 of the adjustor 34, can form the second void 62 comprising comprise a box-like shape that is partially enclosed by the adjustor 34. FIG. 2D further shows the bar 54 that separates the first opening 50 and the second opening 52 can optionally include a smooth top surface. In other embodiments, a textured or rough surface may be used or formed as part of the bar 54. FIG. 2E, shows another perspective view of the adjustor 34 from an angle opposite that shown above in FIG. 2D. As such, FIG. 2E shows a perspective view of the back surface 48 and the side surface 46 of the adjustor 34 to provide additional detail of a bottom surface of the adjustor, which can be patterned or textured as desired.

FIG. 2F illustrates another perspective view of the adjustor 34 that displays multiple side surfaces 46, the front surface 40, the bar 54, the second opening 52, and the third opening 56. A size or dimension of the third opening 56, such as a height H3 of the third opening 56, can be small enough to apply pressure to the first strap 36 and the second strap 38 to prevent slipping of the first strap 36 and the second strap 38, even when the straps are in a relaxed state and are not in tension. Furthermore, a size or dimension of the third opening 56, similar to the size or dimensions of all other openings, can be sized to be large enough to allow for, and satisfy constraints of, manufacturing of the adjustor 34. The adjustor 34 can be manufactured using a desired manufacturing process, such as through molding, injecting molding, or other molding process to form the adjustor 34 as a single integrally formed piece or body to be a one-piece adjustor 34. The adjustor 34 can be made of any suitable material or combination of materials, including metal, plastic, resin, polymer, acrylic, or fiber, including polycarbonate (PC), polyethylene (PE), polyethylene terephthalate (PET), polyvinyl chloride (PVC), vinyl nitrile (VN), or other suitable material.

FIGS. 3A-3E provide details regarding a second exemplary embodiment of a one-piece no slip adjustor or adjustor 74 that is similar to the adjustor 34 described above. As such, the details relating to similarly numbered elements and features discussed above with respect to the adjustor 34 can be equally applicable with respect to the adjustor 74; however, in the interest of brevity, those details are not repeated here below. Nevertheless, the adjustor 74, like the adjustor 34, while being referred to as a no slip adjustor can allow for some slippage or relative movement. As used herein, the term no slip as used with respect to the adjustor 74 can mean that slippage or relative movement between the adjustor 74 and the first strap 36 and the second strap 38, can be minimal, de minimis, negligible, or reduced with respect to the conventional one-piece strap adjustor 10 and the first strap 26 and the second strap 28. Due to particular features of the adjustor 74, the first strap 36 and the second strap 38 do not have a tendency to loosen and move relative to each other or relative to the adjustor 74 as is the case with the conventional one-piece strap adjustor 10 and the first strap 26 and the second strap 28 if there is not constant tension applied to the first strap 36 and the second strap 38.

Figure 3A:
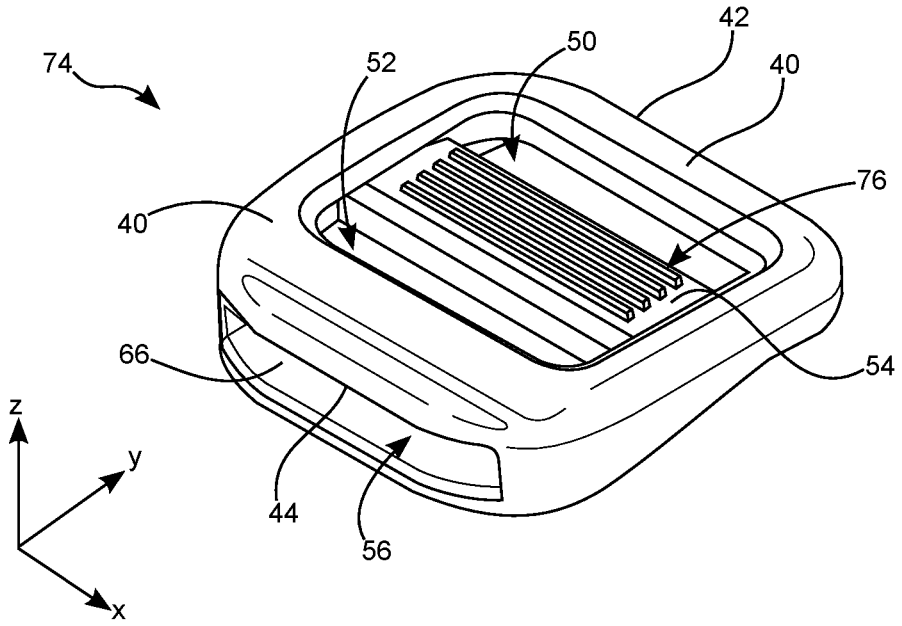
FIGS. 3A-3E show various views of another embodiment of a no slip one-piece strap adjustor.

FIG. 3A is a perspective view of the adjustor 74 that shows the front surface 40 and multiple side surfaces 46, together with the first opening 50, the second opening 52, the bar 54, and the third opening 56. The adjustor 74, like the adjustor 34, can be formed with the bar 54 comprising a smooth surface or a roughened or textured surface. FIG. 3A shows a non-limiting example of the adjustor 74 in which the bar 54 comprises a roughened or textured surface 76 that can include raised portions, ribs, ridges, teeth, grooves, channel, bumps, divots, or other feature that can be added to adjust or control the friction or resistance between the bar 54 and the first strap 36, or the second strap 38, as well as an ease of adjustment or an amount of force that is applied by the user 32 to move the first strap 36 and the second strap 38 through the adjustor 74. A height, area, size, or amount of the textured surface 76 can be directly proportional to an amount of force needed to move or adjust the first strap 36 and the second strap 38. For example, an larger size or amount of the textured surface 76 can require a larger amount of force to move or adjust the first strap 36 and the second strap 38 through the adjustor 74.

Figure 3B:
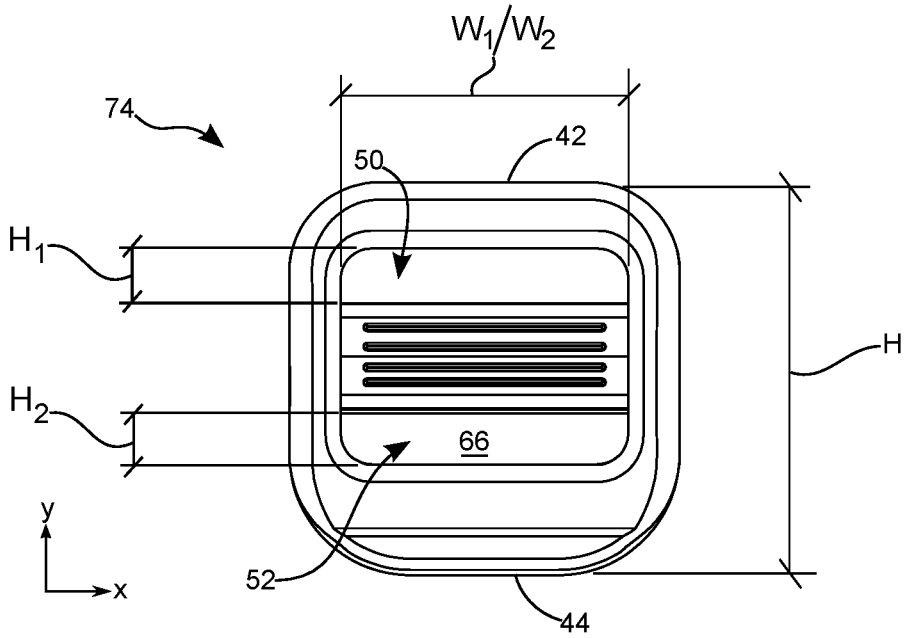

FIG. 3B shows a plan view of the adjustor 74 that shows the front surface 40 of the adjustor 74 as well as the first opening 50, the bar 54 comprising textured surface 76, and the second opening 52. Similar to the adjustor 34, the adjustor 74 can comprise the first opening 50 being formed so as to extend completely through the front surface 40 and the back surface 48, while the second opening 52 can extend only partially and not completely through the adjustor 74 so as to pass through the front surface 40 but not the back surface 48. Thus, the interior surface 66 of the adjustor 74 can be visible through the second opening 52 as shown in FIG. 3B. As such, the adjustor 74 can vary with respect to conventional adjustors, like the conventional adjustor 10, that comprise two open slots like opening 12 and opening 14, both of which extend completely through the adjustor 10 between opposing front and back surfaces.

FIG. 3B also shows that a height H of the adjustor 74 can be in a range of 20-30 millimeters (mm) including a height of about 26 mm, plus or minus up to one or two millimeters. A height H1 of the first opening 50 can be in a range of 2-5 mm including a height of 3.6 mm, or about 3.6 mm, plus or minus up to one millimeter. A height H2 of the second opening 52 can be in a range of 2-5 mm including a height of 3.4 mm, or about 3.4 mm, plus or minus up to one millimeter.

Figure 3C:
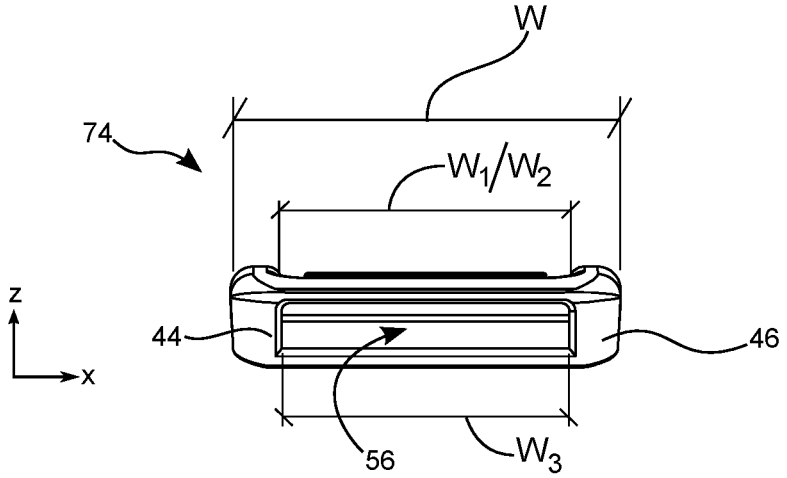

Turning to FIG. 3C, FIG. 3C shows a side profile view of the side surface 46 including the bottom edge 44 of the adjustor 74. A portion of the second opening 52 and the third opening 56 are also visible in the view shown in FIG. 3C. The second opening 52 is shown formed in the front surface 40 comprising a width W2 that can be equal to, or substantially equal to, a width W1 of the first opening 50 as well as a width W3 of the third opening 56. In some embodiments, the width W2 can be in a range of 14-23 mm or about 19 mm plus or minus less than one or two millimeters. The widths W1-W3 can be the same or different from each other, and will comprise a width that is less than an overall width W of the adjustor 74. The width W of the adjustor 74 can comprise a width in a range of 21-30 mm, or about be 25.8 mm, plus or minus less than one or two millimeters. As shown in FIG. 3C, the third opening 56 can comprise an exterior edge or shape that is formed as a rectangle, loop, ring, or other suitable shape that can provide contact or compress the first strap 36 and the second strap 38, such as on one or more sides opposing sides of the straps, such as on those portion of the first strap 36 and the second strap 38 that are closes the front surface 40 and the back surface 48 of the adjustor 74.

Figure 3D:
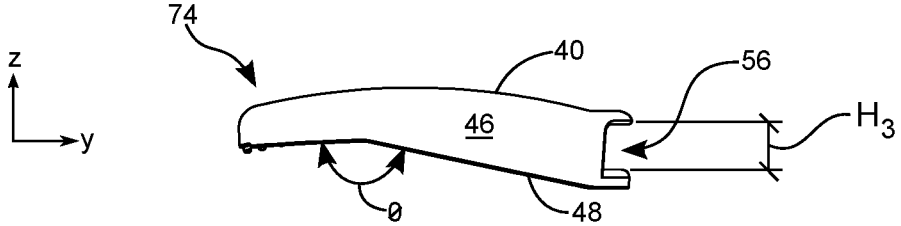

FIG. 3D shows a profile or side view of the adjustor 74 in which a height H3 of the third opening 56 is indicated. The height H3 can be in a range of about 2-6 mm, or about 3.5 mm plus or minus less than 1 or 2 mm. An uneven or angled back surface 48 comprising the interior angle θ can also be included, similar to the angled back surface 48 described above with respect to the adjustor 34.

Figure 3E:
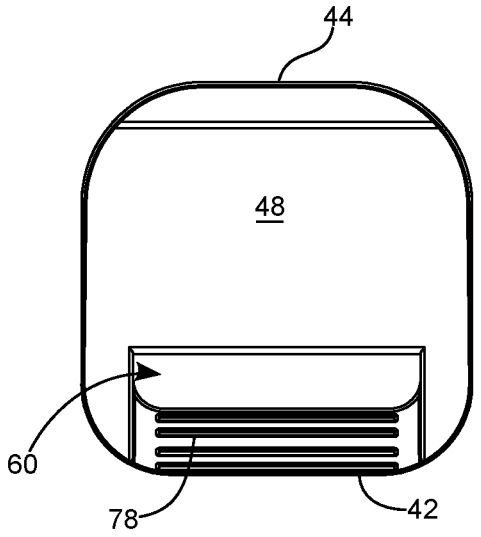

FIG. 3E shows a plan view of the adjustor 74, opposite the plan view of FIG. 3B. FIG. 3E shows the back surface 48 and the first void 60 being exposed through the back surface 48. Additionally, a portion of the back surface 48 between the top edge 42 and the void 60 can comprise a roughened or textured surface 78 similar to the textured surface 76 of the bar 54. By including the textured surface 78, an amount of force that is needed to be applied to the first strap 36 or the second strap 38 by the user 32 can be adjusted for achieving a desired amount of relative movement between the first strap 36, the second strap 38, and the adjustor 74.

FIGS. 4A-4E provide detail regarding a third exemplary embodiment of a one-piece no slip adjustor or adjustor 84 that is similar to the adjustors 34 and 74 described above. As such, the details relating to similarly numbered elements and features discussed above with respect to the adjustors 34 and 74 can be equally applicable with respect to the adjustor 84; however, in the interest of brevity, those details are not repeated here below. Nevertheless, the adjustor 84, like the adjustors 34 and 74, while being referred to as a no slip adjustor can allow for some slippage or relative movement. As used herein, the term no slip as used with respect to the adjustor 84 can mean that slippage or relative movement between the adjustor 84 and the first strap 36 and the second strap 38, can be minimal, de minimis, negligible, or reduced with respect to the conventional one-piece strap adjustor 10 and the first strap 26 and the second strap 28. Due to particular features of the adjustor 84, the first strap 36 and the second strap 38 do not have a tendency to loosen and move relative to each other or relative to the adjustor 84 as is the case with the conventional one-piece strap adjustor 10 and the first strap 26 and the second strap 28 when there is not constant tension applied to the first strap 36 and the second strap 38.

Figure 4A:
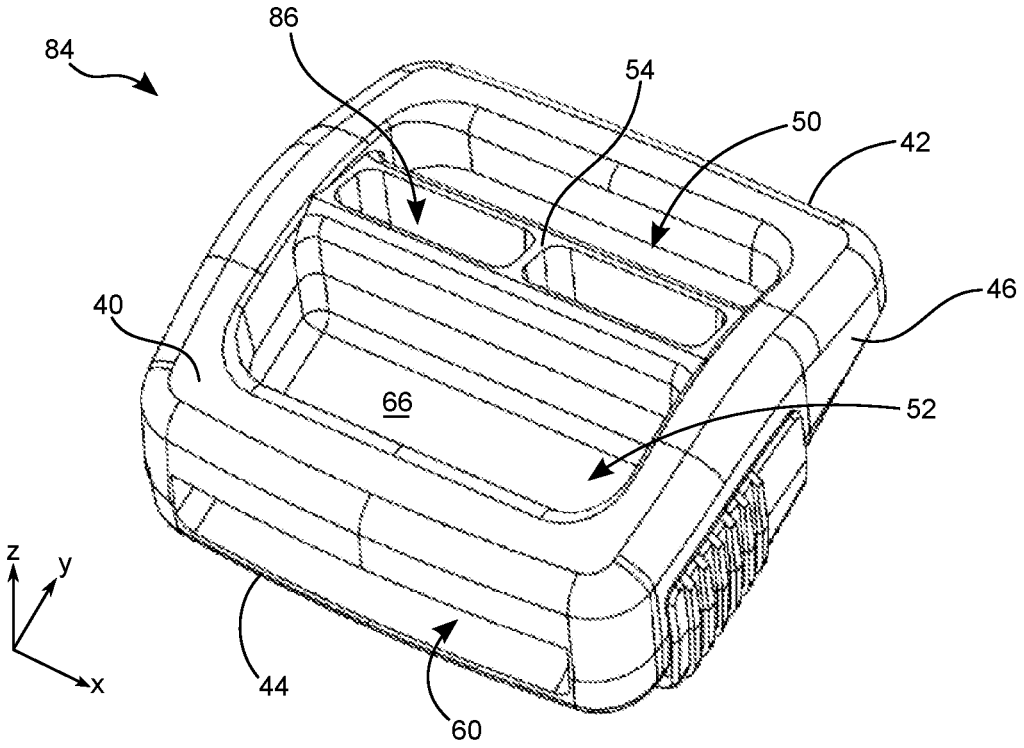
FIGS. 4A-4E show various views of another embodiment of a no slip one-piece strap adjustor.

FIG. 4A is a perspective view of the adjustor 84 showing the front surface 40, multiple side surfaces 46, the first opening 50, the second opening 52, the bar 54, and the third opening 56. The bar 54 is shown disposed between the first opening 50 and the second opening 52. The bar 54 of the adjustor 84 can be similar or identical to the bar 54 of the adjustor 34 and the adjustor 74. Alternatively, the bar 54 of the adjustor 84 can also differ from the bar 54 of the adjustor 34 and the adjustor 74 by inclusion of a number of bar openings or holes 86 that can extend partially or completely through the bar 54 from the front surface 40 of the bar 54 to the back surface 48 of the bar 54. Additionally, or alternatively, the bar 54 can be formed as multiple bars or a plurality of bars 54 that are connected by a number of perpendicular spacers or angled reinforcement for form the bar openings 86. The bar openings 86 do not need to be large enough to receive either the first strap 36 or the second strap 38, but can operate as a roughened or textured surface, similar to roughened or textured surface 76, that can modify an ease of adjustment or an amount of force that is needed to be applied to move the first strap 36, the second strap 38, or both, and the adjustor 84 relative to each other.

Figure 4B:
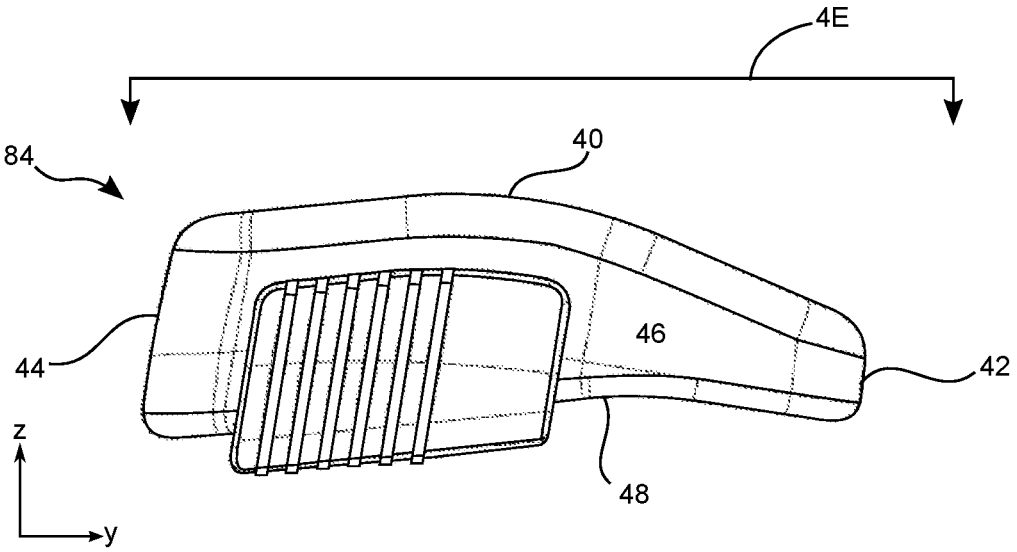
Figure 4C:
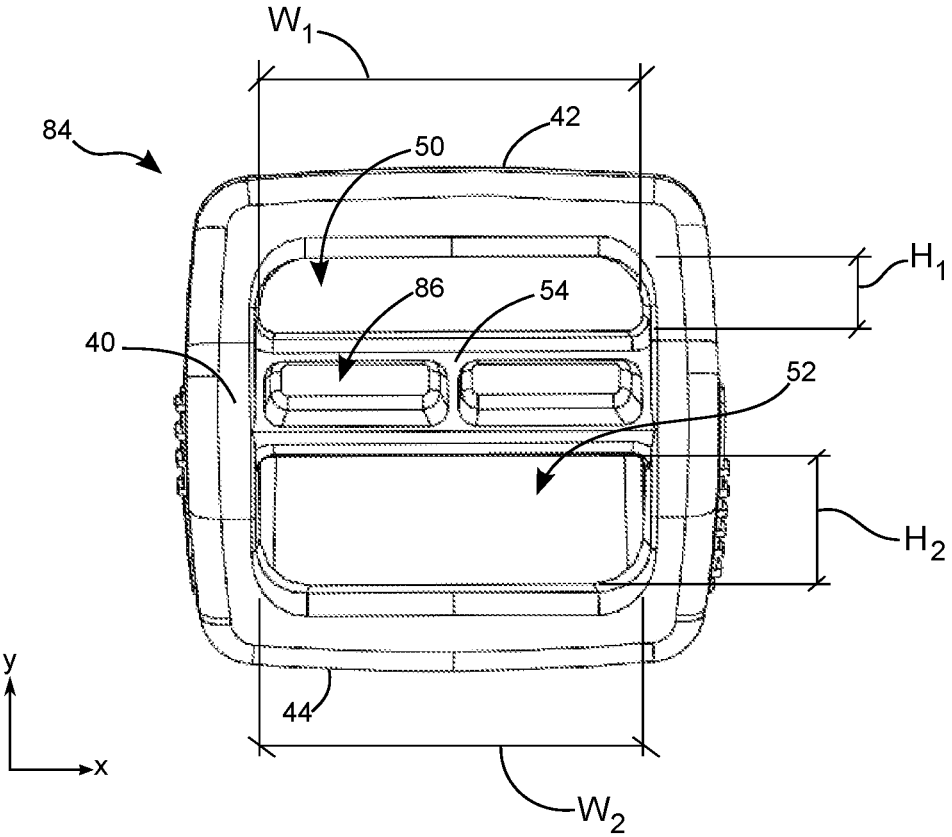
Figure 4D:
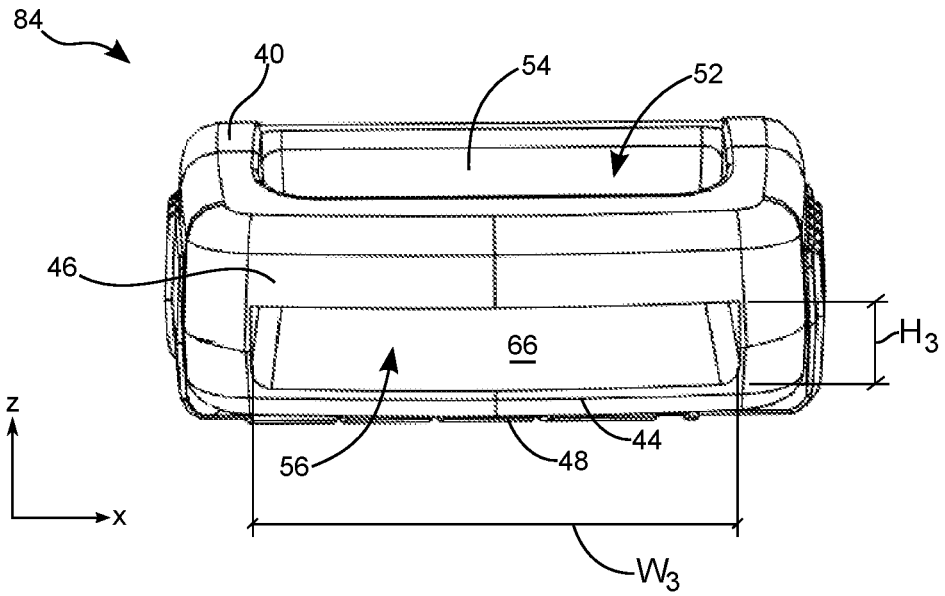
Figure 4E:
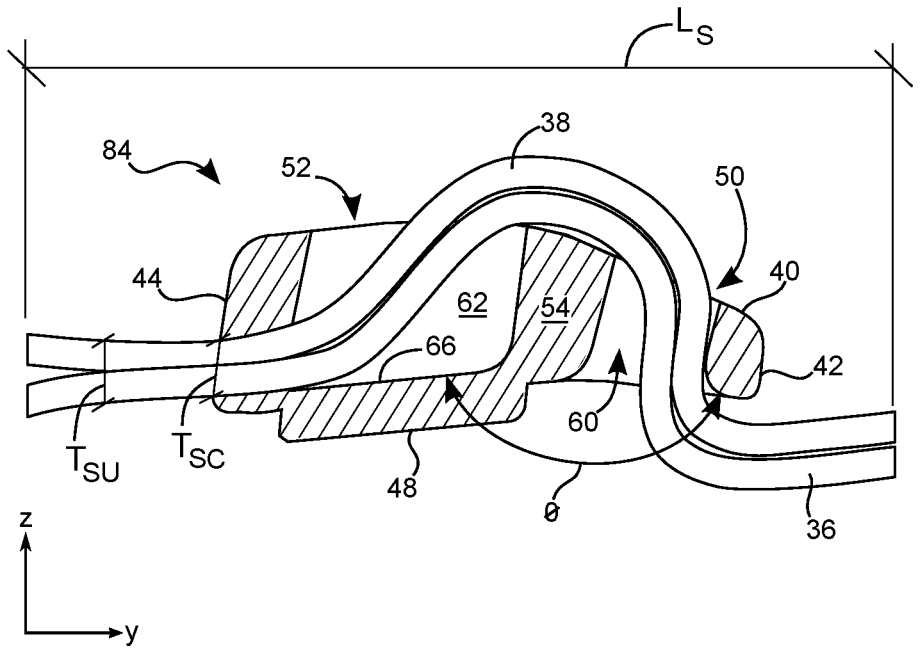

FIG. 4B, provides a side view of the adjustor 84 that shows the adjustor 84 at an angle, or in a position, similar to the cross sectional view of the adjustor 84 shown in FIG. 4E. FIG. 4B also shows that additional functional elements, design elements, or both, can be added to the adjustor 84, such as grooves, channels, or roughened texture that does not interact directly with the first strap 36 or the second strap 38, but can improve an interaction between a user, such as user's fingers handling the adjustor 84, and the adjustor 84.

FIG. 4C shows a top view of the adjustor 84 together with a number or non-limiting exemplary dimensions for the first opening 50 and the second opening 52. A height H1 of the first opening 50 can be in a range of 1.5-5 mm including a height of 3.2 mm, or about 3.2 mm, plus or minus less than one or two millimeters. A height H2 of the second opening 52 can be the same, similar, or different than the height H1 of the first opening 50. For example, the height H2 of the second opening H2 can be in a range of 4-9 mm including a height of 6.6 mm, or about 6.6 mm, plus or minus less than one or two millimeters. A width W1 of the first opening 50 can be in a range of 10-30 mm, or 15-21 mm, including a height of 18.1 mm, or about 18.1 mm, plus or minus less than one or two millimeters. A width W2 of the second opening 52 can be the same, similar, or different than the width W1 of the first opening 50. For example, the width W2 of the second opening 52 can be in a range of range of 10-30 mm, or 15-21 mm, including a width of 18.4 mm, or about 18.4 mm, plus or minus less than one or two millimeters.

FIG. 4D shows a view similar to the view shown in FIG. 3C. FIG. 4D also shows a profile view of the adjustor 84 including the bottom edge 44, the side surface 46, and a portion of the front surface 40. FIG. 4D further shows a number or non-limiting exemplary dimensions for the third opening 56. A height H3 of the third opening 56 can be the same, similar, or different than the heights H1 and H2 the first opening 50 and the second opening 52, respectively. For example, the height H3 of the third opening can be in a range of 1-4 mm including a height of 2.5 or 2.9 mm, or about 2.5 or 2.9 mm, plus or minus less than one or two millimeters. In other embodiments, the height H3 can be any height that allows for, or provides, some compression of the first strap 36 and the second strap 38 to prevent the first strap 36 and the second strap 38 from sliding or moving relative to the adjustor 84 when little or no tension is applied to the first strap 36 and the second strap 38. A width W3 of the third opening 56 can be the same, similar, or different than the widths W1 and W2 of the first opening 50 and the second opening 52, respectively. For example, the width W3 of the third opening 56 can be in a range of range of 10-30 mm, or 15-21 mm, including a width of 18.7 mm, or about 18.7 mm, plus or minus less than one or two millimeters. As shown in FIG. 4D, the second opening at the second end can be configured as a loop or ring that can provide contact on four sides of a strap, or two sides of a strap, and can apply pressure to the strap from opposing portions of the top and bottom surfaces of the adjustor.

FIG. 4E, shown below, is cross-sectional side view of the adjustor 84, the first strap 36, and the second strap 38. FIG. 4E is similar to the cross-sectional side view of the adjustor 34 shown in FIG. 2C, but FIG. 4E shows the adjustor 84 is rotated with respect to the adjustor 34 in FIG. 2C so that the top edge 42 of the adjustor 84 in FIG. 4E is shown at the right of the figure and the bottom edge 44 of the adjustor 84 is shown at the left of the figure. FIG. 4E also differs from FIG. 2C in that the first strap 36 and second strap 38 in the adjustor 84 are not shown in tension, as they are in FIG. 2C. The first strap 36 and the second strap 38 shown in tension in FIG. 2C are representative of a situation in which the helmet 30 or other device is being worn by the user 32 and the first strap 36 and the second strap 38 are being used to hold the helmet 30 or other device to the user 32.

The first strap 36 and the second strap 38 shown without being in tension in FIG. 4E are representative of the straps being in a situation in which the helmet 30 or other piece of equipment is not being worn or used by the user 32, or is in-between uses. As shown, the first strap 36 and second strap 38 can be pinched together by the adjustor 84 so that the first strap 36 and the second strap 38 can be in compression when exiting from the third opening 56 of the adjustor 84. The third opening 56 can comprise a height H3 that is equal to or less than a combined thickness of the first strap 36 and the second strap 38 in an uncompressed or free state. Thus, when the first strap 36 and the second strap 38 pass through the third opening 56, the adjustor 84 at the edges of the third opening 56 can pinch or compress the first strap 36 and the second strap 38 so that the first and second straps do not move with respect to the adjustor 84, even when the straps 36, 38 are not in tension. Previously, conventional one-piece adjustors, like adjustor 34 shown above in FIGS. 1A and 1B, were known to self-adjust between uses because of shifting that would occur between the first strap 26, the second strap 28, and the adjustor 10 when the first and second straps were not in tension. However, as illustrated in FIG. 4E, the structure and form of the adjustor 84, as well as the adjustors 34 and 74, can eliminate the need of frequent readjustment of one-piece strap adjustors and straps because the pinching or compression of the first strap 36 and the second strap 38 that occurs at the third opening 56 to prevent relative movement between the straps and the adjustor 84 irrespective of whether the straps are in a relaxed state and not in tension, such as when the helmet 30 is being worn by the user 32.

Accordingly, the one-piece no slip adjustor disclosed herein provides a number of advantages over conventional one-piece adjustors and multi-piece adjustors such as 2-piece adjustors, for both manufacturing of the adjustors and for coupling and aligning straps, such as straps used for attaching a helmet to a head of a user. First, the one-piece no slip adjustor, because it includes a single piece, provides a design that is simple, durable, and easy to make. The one-piece no slip design has a smaller size than the multi-piece adjustors, does not have the extra pieces for attachment of multiple parts, and as such is easier to make or manufacture, can be made for a lower cost, and is less susceptible to damage and breakage. On the other hand, two-piece and multi-piece designs can lack a center bar and are more expensive and less robust than the one-piece no slip adjustor.

Additionally, a one-piece no slip adjustor has the additional advantage of looking like existing one-piece adjustors, which is a desirable aesthetic especially for conservative users like those in BMX riding and racing, who typically prefer traditional designs. Thus, the one-piece no slip adjustor provides the additional benefit of comprising a traditional aesthetic similar to conventional one-piece adjustors that is not present for multi-piece adjustors, while also providing the additional functionality of preventing slipping and relative movement between the straps and the adjustor that is not available with the conventional one-piece adjustors.

Furthermore, by forming the one-piece no slip adjustor of plastic in a molding process, a height of the third opening can be formed such that it is less than a thickness of the straps or webbing that will pass through the third opening, when the straps or webbing are in relaxed state. The reduced thickness of the third opening provides increased friction and adjusts a force needed to move or adjust the straps or webbing. Optional ridges can also be formed at various points along the path of the straps, such as on a central bar, an outer bar, or within or around one or more of the first opening, the second opening, or the third opening to adjust friction and a force needed to move or adjust the straps or webbing with respect to the adjustor. Similarly, angles, turns, and a path of the straps can be designed and controlled to create a desired treacherous path or geometry that adjusts friction and a force needed to move or adjust the straps or webbing with respect to the adjustor.

The second opening and the third opening can together form the second void that can be at least partially formed or defined by an interior surface of the void, including surface opposite the back surface of the adjustor. The shape of the second void relative to the positioning of the second opening and the third opening can cause the first strap and the second strap to a twist, turn, or bend while passing through the void, which is in contracts to conventional open designs that allow the straps to pass directly between opposing sides of the adjustor, such as top and bottom sides, without twists, turns, or bends. The interior surface of the second void can be used in helping direct the straps to the third opening, and to make a turn or curve within the second void, such as turn or curve of approximately 90 degrees, plus or minus 30 degrees. In other embodiments, less material can be used in forming the adjustor by omitting the interior surface and having a smaller surface area of the adjustor define the second void.

Where the above examples, embodiments and implementations reference examples, it should be understood by those of ordinary skill in the art that other helmet and manufacturing devices and examples could be intermixed or substituted with those provided as virtually any components consistent with the intended operation of a method, system, or implementation may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation. In places where the description above refers to particular embodiments of on-piece no slip strap adjustors for helmets, it should be readily apparent that a number of modifications may be made without departing from the spirit thereof and that these embodiments and implementations may be applied to other to gear and equipment technologies as well. Accordingly, the disclosed subject matter is intended to embrace all such alterations, modifications, and variations that fall within the spirit and scope of the disclosure and the knowledge of one of ordinary skill in the art. The presently disclosed embodiments are, therefore, to be considered in all respects as illustrative and not restrictive.

What is claimed is:

1. A one-piece strap adjustor with a first strap and a second strap, comprising:

a front surface;

a back surface opposite the front surface;

a side surface that extends between the front surface and the back surface;

a first opening in the front surface, wherein the first opening extends completely through the strap adjustor from the front surface to the back surface;

a second opening in the front surface that extends partially but not completely through the strap adjustor;

a bar at the front surface between the first opening and the second opening;

a third opening in the side surface that extends partially but not completely through the strap adjustor and joins with the second opening, wherein a first portion of the side surface adjacent the front surface forms a first edge of the third opening and a second portion of the side surface adjacent the back surface forms a second edge of the third opening, a height H3 of the third opening extending from the first edge of the third opening to the second edge of the third opening; and a first strap and a second strap extending together through the strap adjuster along the back surface, then through the first opening in the back surface to the front surface, then along the front surface to the second opening, then through the second opening into the strap adjustor and exiting through the third opening.

2. The strap adjustor of claim 1, wherein the third opening is configured to compress the first and second straps to limit the first and second straps from slipping through the third opening when tension is reduced along a length of the first and second straps, and wherein the height H3 of the third opening is greater than a compressed strap thickness Tsc of a first strap and a second strap stacked on the first strap, but is smaller than an uncompressed thickness Tsu of the first strap and the second strap stacked on the first strap.

3. The strap adjustor of claim 1, wherein the bar comprises a textured surface of raised surfaces or grooves extending between side surfaces perpendicular to the front surface and the back surface, the raised surfaces or grooves oriented in a direction perpendicular to a direction extending from the first opening to the second opening.

4. The strap adjustor of claim 1, wherein the second opening intersects with the third opening to provide a void configured to receive the first and second straps having a changed direction within the void before exiting the void through the third opening.

5. The strap adjustor of claim 1, wherein the back surface comprises an included angle at an exterior of the strap adjustor and about the first opening, wherein the included angle is less than 180 degrees.

6. The strap adjustor of claim 1, wherein the side surface is substantially perpendicular to at least one of the front surface and the back surface.

7. A method of making the strap adjustor of claim 1, comprising molding the strap adjustor of a single piece of plastic.

8. A one-piece strap adjustor with at least one strap, comprising:

a front surface at an exterior of the strap adjustor;

a back surface at an exterior of the strap adjustor opposite the front surface;

a side surface at an exterior of the strap adjustor that extends between the front surface and the back surface;

a first opening in the front surface, wherein the first opening extends completely through the strap adjustor from the front surface to the back surface;

a second opening in the front surface that extends partially but not completely through the strap adjustor; and a third opening in the side surface that extends partially but not completely through the strap adjustor and joins with the second opening, wherein a first portion of the side surface adjacent the front surface forms a first edge of the third opening and a second portion of the side surface adjacent the back surface forms a second edge of the third opening, a height of the third opening extends from the first edge of the third opening to the second edge of the third opening;

wherein at least one strap extends through the strap adjuster along the back surface, through the first opening in the back surface to the front surface, along the front surface to the second opening, through the second opening into the strap adjustor and through the third opening.

9. The strap adjustor of claim 8, further comprising a bar at the front surface between the first opening and the second opening, wherein the bar comprises a textured surface configured to increase friction or resistance between the strap adjustor and the at least one strap that passes over the bar.

10. The strap adjustor of claim 9, wherein:

the second opening intersects with the third opening to provide a void configured to receive the at least one strap having a changed direction within the void before exiting the void through the third opening.

11. The strap adjustor of claim 8, wherein the back surface comprises an included angle that is less than 180 degrees.

12. The strap adjustor of claim 8, wherein a height H3 of the third opening is greater than a compressed strap thickness Tsc of the at least one strap, but is smaller than an uncompressed thickness Tsu of the at least one strap.

13. The strap adjustor of claim 8, wherein the front surface is substantially parallel to the back surface.

14. The strap adjustor of claim 8, further comprising:

a first strap of the at least one strap disposed through the third opening with a length of the first strap being substantially perpendicular to a width of the third opening or the height of the third opening;

a second strap of the at least one strap stacked over the first strap, the second strap disposed through the third opening with a length of the second strap being substantially perpendicular to a width of the third opening or the height of the third opening; and wherein the height of the third opening is less than an uncompressed thickness of the first strap and the second strap.

15. The strap adjustor of claim 8, wherein:

the height of the third opening is equal to a compressed thickness of a first strap of the at least one strap and a second strap of the at least one strap stacked over the first strap; and the first edge and the second edge of the third opening are configured to compress the first strap and the second strap to limit the first strap and the second strap from slipping through the third opening when tension is reduced along a length of the first strap or the second strap.

16. A method of making the strap adjustor of claim 8, comprising molding the strap adjustor of a single piece of plastic.

17. A one-piece strap adjustor with a strap, comprising:

a front surface;

a back surface opposite the front surface, a first side surface that extends between the front surface and the back surface;

a second side surface that extends between the front surface and the back surface, the second side surface distal to the first side surface;

a first void that extends completely through the strap adjustor from the front surface to the back surface; and a second void that extends partially but not completely through the strap adjustor, the second void being partially enclosed by the back surface and the side surface;

wherein a strap extends through the strap adjustor along the back surface beginning adjacent to the first side surface, through the first void, along the front surface and through the second void into the strap adjustor from the front surface and out of the second void at the second side surface such that the one-piece strap adjustor does not slip along the strap when at rest, but can be slid along the strap by a user; and wherein a height H3 of an exit to the second void is greater than a compressed strap thickness Tsc of the strap, but is smaller than an uncompressed thickness Tsu of the strap.

18. The strap adjustor of claim 17, wherein the second void is configured to receive the strap angled between the front surface and the back surface.

19. The strap adjustor of claim 17, wherein the second void comprises a second opening at the front surface and a third opening in the side surface that extends between the front surface and the back surface.

* * * * *